US010300324B1

(12) United States Patent
Ransom

(10) Patent No.: US 10,300,324 B1
(45) Date of Patent: May 28, 2019

(54) WEARABLE WEIGHTED EXERCISE SYSTEM AND METHOD OF USE

(71) Applicant: Francois Ransom, Dallas, TX (US)

(72) Inventor: Francois Ransom, Dallas, TX (US)

( * ) Notice: Subject to any disclaimer, the term of this patent is extended or adjusted under 35 U.S.C. 154(b) by 42 days.

(21) Appl. No.: 15/838,842

(22) Filed: Dec. 12, 2017

Related U.S. Application Data

(63) Continuation-in-part of application No. 15/205,730, filed on Jul. 8, 2016, now abandoned.

(51) Int. Cl.
*A63B 21/065* (2006.01)
*A63B 21/00* (2006.01)
*A63B 21/06* (2006.01)

(52) U.S. Cl.
CPC ..... *A63B 21/065* (2013.01); *A63B 21/0603* (2013.01); *A63B 21/4007* (2015.10); *A63B 21/4009* (2015.10); *A63B 21/4011* (2015.10); *A63B 21/06* (2013.01)

(58) Field of Classification Search
CPC ..... A63B 21/0603; A63B 21/065
See application file for complete search history.

(56) References Cited

U.S. PATENT DOCUMENTS 5,010,596 A * 4/1991 Brown ..... A63B 21/065 2/227
9,168,413 B2 * 10/2015 Petrakis ..... A63B 21/065
10,045,572 B2 * 8/2018 Bratcher ..... A41D 13/0015
2003/0092544 A1 * 5/2003 Reed ..... A63B 21/0603 482/105
2005/0227830 A1 * 10/2005 Tomlin ..... A41D 19/0024 482/105
2010/0319099 A1 * 12/2010 Washington, Sr. ..... A41D 13/0015 2/69
2013/0190144 A1 * 7/2013 Ross ..... A63B 21/0603 482/105
2014/0302970 A1 * 10/2014 Sinclair ..... A63B 21/065 482/105
2017/0304670 A1 * 10/2017 Herron ..... A63B 21/065

* cited by examiner

*Primary Examiner* — Joshua Lee
(74) *Attorney, Agent, or Firm* — Eldredge Law Firm, LLC; Richard Eldredge; Beth Felix

(57) ABSTRACT

A weighted suit includes a sleeveless suit being composed of a neoprene material and to fit around a torso area of a user, the sleeveless suit having two leg compartments to extend to above a knee of the user; a first pair of weights integrated into a chest portion of the sleeveless suit, each of the first pair of weights having a rubber pouch forming an interior cavity; and a pre-determined amount of iron sand permanently secured within the interior cavity of the rubber pouch, the pre-determined amount of iron sand providing weight; the rubber pouch flexes with movement of the user; a second pair of weights integrated into an upper back portion of the sleeveless suit; a third pair of weights integrated into thigh regions of the two leg compartments; each of the third pair of weights is positioned to wrap from a front of the user's leg to a back of the user's leg; and each weight of the first, second, and third pair of weights is permanently sewn into the sleeveless suit to be completely enclosed by the neoprene material, thereby being permanently incorporated into the sleeveless suit.

2 Claims, 7 Drawing Sheets

WEARABLE WEIGHTED EXERCISE SYSTEM AND METHOD OF USE

BACKGROUND

1. Field of the Invention

The present invention relates generally to exercise systems, and more specifically, to a wearable weighted exercise system without open compartments.

2. Description of Related Art

Wearable exercise systems are well known in the art and are effective means to increase the intensity of exercise. For example, FIG. 1 depicts a conventional wearable exercise system 101 having an exercise suit 102 with one or more compartments 103 to hold one or more weights 104. During use, the user adds weights 104 to the compartments 103, as depicted by arrow A, such that the added weight increases the resistance and intensity of the user's exercise.

One of the problems commonly associated with system 101 is its limited use. For example, because weights 103 must be manually added and removed from compartments 103 there is a greater risk that weights 104 will reorient or dislodge from system 101 during use and negatively impact the safety and quality of a user's exercise routine.

Accordingly, although great strides have been made in the area of wearable weighted exercise systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
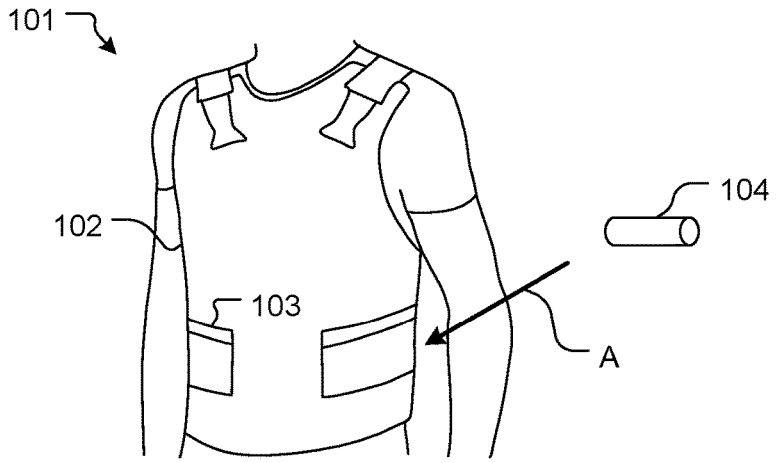
FIG. 1A (Prior Art)
FIGS. 1A and 1B are oblique front views of a common wearable exercise system with weight removed and inserted, respectively.
Figure 1B:
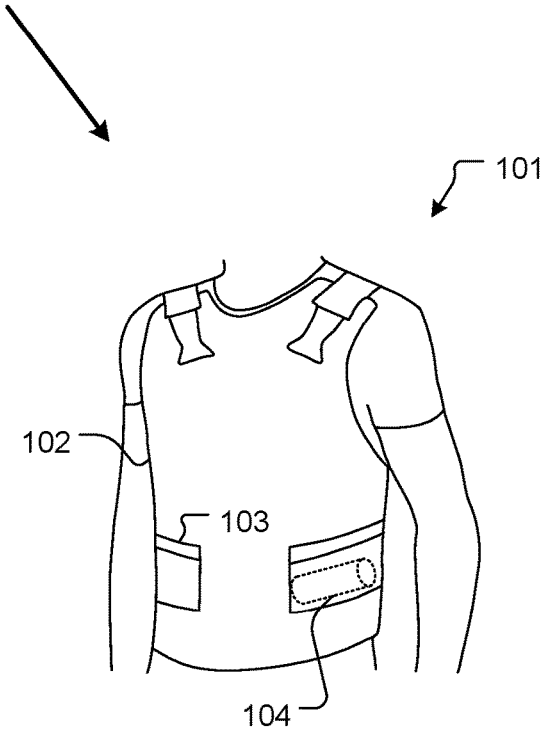
FIG. 1B (Prior Art)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wearable exercise systems. Specifically, the contemplated application permanently integrates weights into the suit to minimize any risk of the weights reorienting or dislodging from the system. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
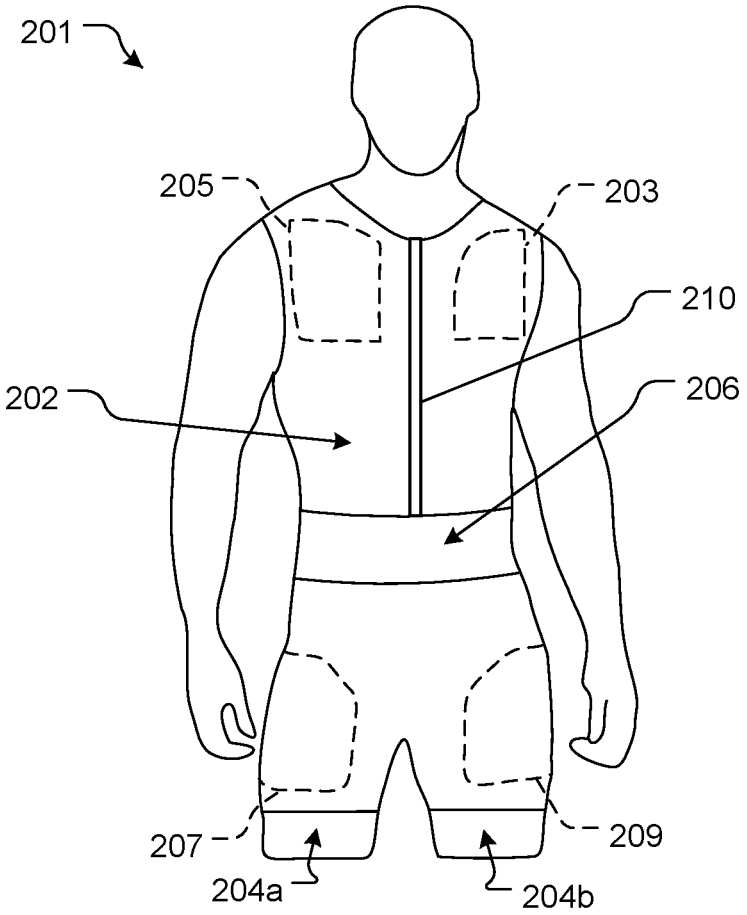
FIGS. 2A and 2B are oblique front and back views of a wearable weighted exercise system in accordance with a preferred embodiment of the present application.
Figure 2B:
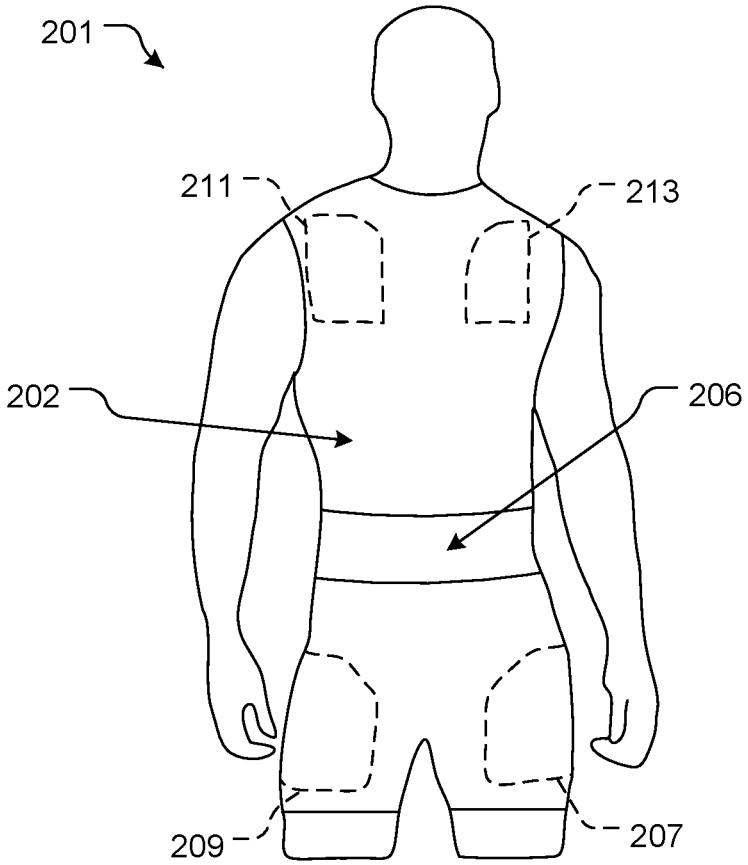

Referring now to the drawings wherein like reference characters identify corresponding or similar elements throughout the several views, FIGS. 2A and 2B depict oblique front and back views respectively of a wearable weighted exercise system in accordance with a preferred embodiment of the present application. It will be appreciated that system 201 overcomes one or more of the above-listed problems commonly associated with conventional wearable weighted exercise systems.

In the contemplated embodiment, system 201 includes a suit 202 with two front upper body weights 203, 205 and two lower body weights 207, 209. As shown in FIG. 2B, the back view further shows two upper body back weights 211, 213 positioned at the top of suit 202. It must be understood that there are no weights on the arms of the user, which provides for full movement and flexibility of the user's arms.

Suit 202 is a single, sleeveless garment configured to secure around the user's torso and having two leg compartments 204*a*, 204*b* to extend to above the users knees. Suit 202 includes a single zipper 210 configured to zip up the suit once in place on the user. Suit 202 having no removable components or the like and is composed of a neoprene material. It should be appreciated that the neoprene allows for moisture wicking and also provides a protective barrier for the user's skin. It should be appreciated that the lack of removable components, and the one-piece feature of the suit makes system 201 novel as it is easy to manufacture, take care of, and transport. In the preferred embodiment, suit 202 is further sleeveless, thereby allowing for full maneuverability of the user's arms.

In some embodiments, system 201 includes a second layer 206 of neoprene around the waist section of suit 202 and integrally stitched to suit 202. It should be appreciated that this second layer provides for improved support for the user.

Lastly, in reference to suit 202, it should be understood that neoprene is known for immense physical toughness, thereby providing the user with improved cushioning and protection for fragile areas of the body. In addition, it must be appreciated that suit 202 is completely latex free, thereby being suitable for persons with common allergies.

In the preferred embodiment, top front weights 203, 205 are positioned on the user's chest and are approximately 1.25 lbs each. The top back weights 211, 213 are positioned on the upper back and are approximately 1.25 lbs each. Lastly, in the preferred embodiment, the lower body weights 207, 209 are specifically positioned to wrap around the thighs, and are approximately 2.5 lbs each. It should be understood that the total weight of the entire system is approximately 10 pounds, having 5 pounds on the top of the user's body and 5 pounds on the lower portion of the user's body.

In the preferred embodiment, the top front and back weights are each an approximate size of 21×10 centimeters. Likewise, in the preferred embodiment, the lower weights are approximately 21×28 centimeters.

Figure 3:
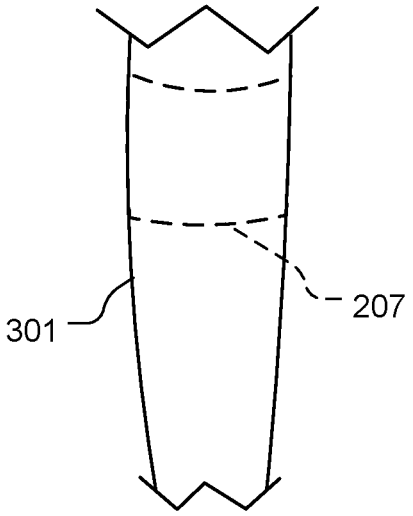
FIG. 3 is a side view of a thigh weight from FIG. 2.
Figure 4:
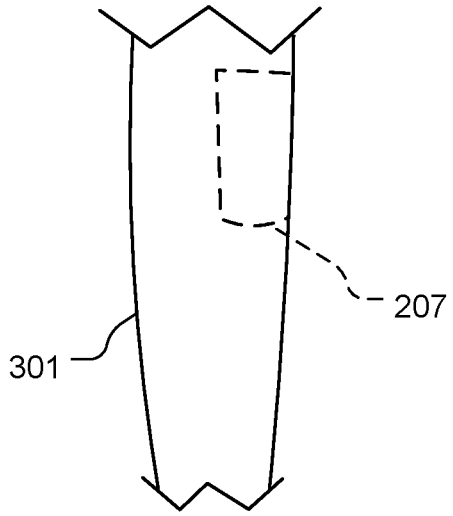
FIG. 4 is a back view of the thigh weight from FIG. 2.

The positioning of thigh weights 207, 209 is further shown in FIGS. 3 and 4. In FIG. 3, a side view of a weight 207 is shown. In FIG. 4, a back view of weight 207 is shown. It should be understood that the weight is wrapped around the thigh 301, thereby placing the weight in an ideal position for optimal movement by the user.

Figure 5:
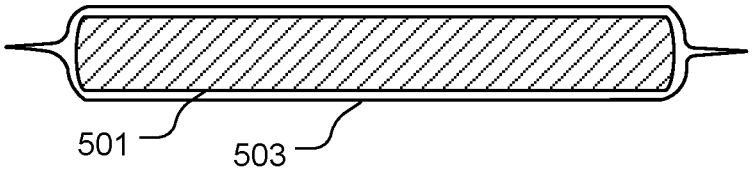
FIG. 5 is a cross sectional view of one of the weights of FIG. 2.

The weights of system 201 are specifically woven/sewn into the material that composes the suit, preferably with a polyester thread. One specifically contemplated thread is a heavyduty polyester thread, such as Kevlar® thread, known to be strong, durable, and heat resistant. In addition, it is contemplated that the thread should be of a weight approximately 30 LBS. It should further be appreciated that this thread can be used in all aspects of system 201 not just for use in stitching the weights into the suit. In FIG. 5, a cross sectional view shows a weight 501 (which should be understood to be any of the weights discussed above) sewn into material 503 which makes up the suit. It should be understood that weight 501 is completely encompassed within the material, thereby not being in a position to come in contact with the user's skin. The neoprene material is stitched around the entire weight, thereby enclosing the weight.

Figure 6:
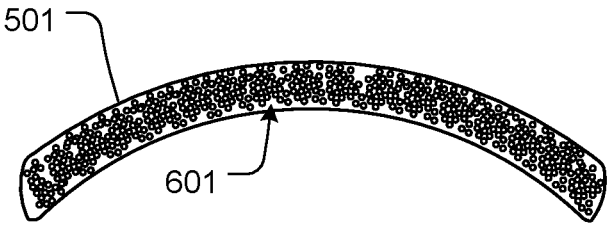
FIG. 6 is a side view of one of the weights of FIG. 2.

In FIG. 6, weight 501 is shown, wherein weight 501 is filled in an internal cavity with an iron sand 601 to reach the desired weight. In the preferred embodiment, the body of weight 501 is composed of a soft, impenetrable rubber pouch, thereby preventing leaking of the sand. In addition, the rubber pouch is flexible, thereby allowing for the weight to move with the user's body, as shown in FIG. 6.

It should be appreciated that one of the unique features believed characteristic of the present application is that upper and lower body weighted components are integrated into the suit 202 without need for use of pockets, compartments, or any other open chamber, thereby preventing the weights from becoming disoriented or dislodge from the particular placement of the weights during use. It is contemplated that weighted components can be integrated into the suit 202 by stitching, weaving, fusing, or by any other means and completely disposed within the thickness of the suit.

It is also contemplated and will be appreciated that so long as weighted components are not located at the user's center of mass, such as the hips or waist, that system 201 will additionally engage the user's core musculature (not shown) for stability during exercise.

Another unique feature believed characteristic of the present application is that system 201 can be easily adopted by a user for personal training or coaching. For example, because the weighted components are fully integrated into suit 202 the system 201 can be treated as a single unit to eliminate the need to track, maintain, or store individual system components.

Some of the unique feature of the suit include that there are not separate components, e.g., a shirt and shorts, and that the suit is a single piece of garment. In addition, there are no pocket and no need to take weighted material in and out of a pocket. The material is woven into the soft, stretchable rubber suit material and there is no need to clean the weights. The suit material is also washable, which in turn greatly increases the desired use as conventional suits become scented with sweat after a single use. In one contemplated embodiment, the weighted material is composed of an elastic material, which in turn allows for expanding and contracting as the user exercises.

It should be appreciated that one of the benefits and unique features of the present system is the ability of the system to be washed in its entirety, without removing the weights and without any special equipment.

Figure 7:
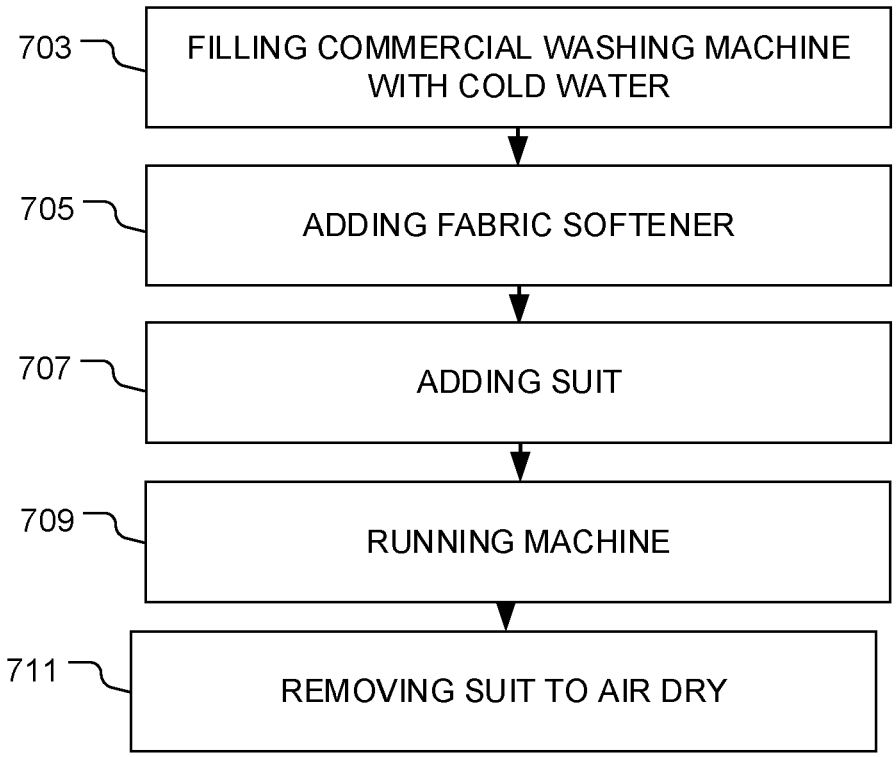
FIG. 7 is a flowchart of a method of washing the wearable weighted exercise system of FIG. 2.

In FIG. 7, a flowchart 701 demonstrates a first method of washing system 201 with a commercial washing machine. It should be understood that a commercial washing machine means a machine, such as a high capacity top loading washing machine that can tolerate between 12-15 pounds or a front loading washing machine that can tolerate approximately 18 pounds. The user first fills the washing machine with cold water and adds a fabric softener, as shown with boxes 703, 705. System 201 is then added and the machine is run, as shown with boxes 707, 709. The system is removed and allowed to air dry, as shown with box 711.

Figure 8:
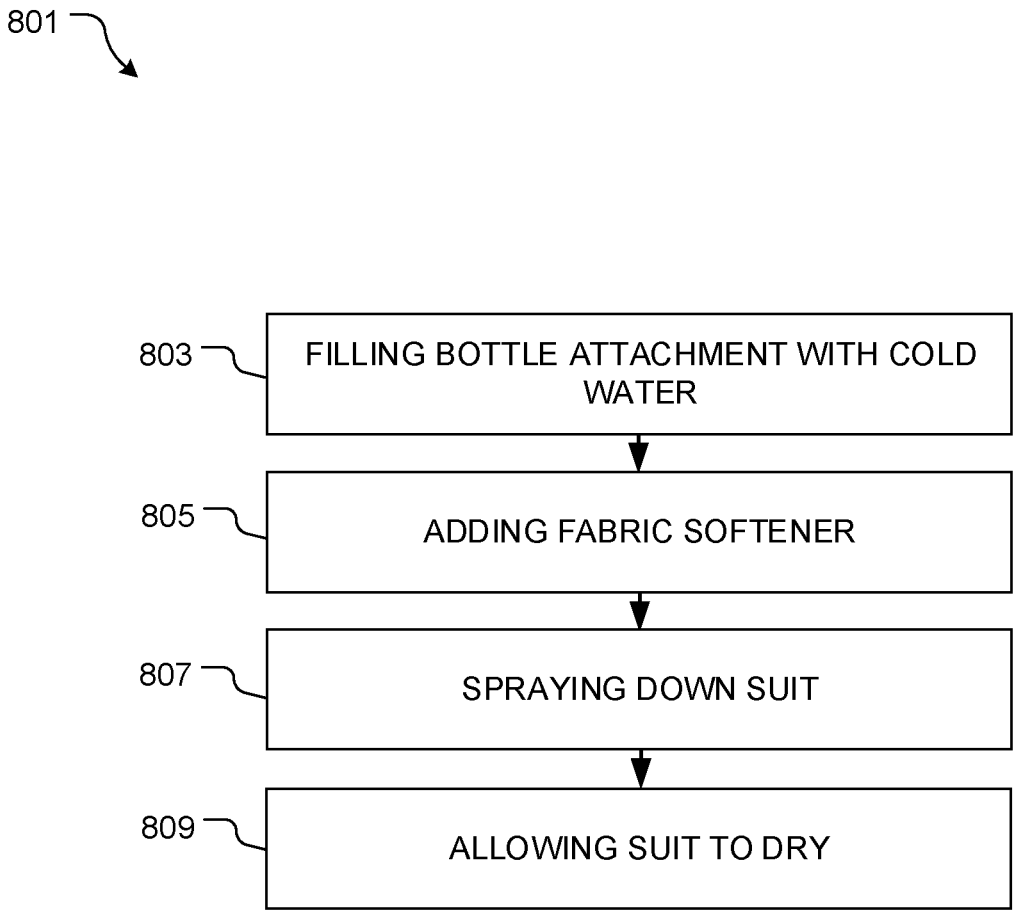
FIG. 8 is a flowchart of a second method of washing the wearable weighted exercise system of FIG. 2.

In FIG. 8, a second flowchart 801 demonstrates a second method of washing system 201 with a bottle attachment to a hose. First, the bottle attachment is filled with cold water and fabric softener is added to the bottle, as shown with boxes 803, 805. The suit is then sprayed down on the inside and outside, as shown with box 807. The suit is then allowed to air dry, as shown with box 809.

It should be appreciated that the methods of washing system 201 are convenient and allow for cleaning without removal of any weights or additional items from the suit, thereby being a novel feature of the present invention.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A weighted suit, comprising:

a sleeveless suit being composed of a neoprene material and configured to fit around a torso area of a user and having a single zipper to secure the sleeveless suit in place on the torso, the sleeveless suit having:

two leg compartments configured to extend to above a knee of the user;

a first pair of weights integrated into a chest portion of the sleeveless suit, each of the first pair of weights having:

a rubber pouch forming an interior cavity; and a pre-determined amount of iron sand permanently secured within the interior cavity of the rubber pouch;

wherein the rubber pouch flexes with movement of the user; and wherein each of the first pair of weights is secured to a pectoral region of the sleeveless suit and is secured substantially flat within the neoprene material;

a second pair of weights integrated into an upper back portion of the sleeveless suit, the second pair of weights each having:

a rubber pouch forming an interior cavity filled with a pre-determined amount of iron sand;

wherein each of the second pair of weights is secured to the upper back portion of the sleeveless suit and is secured substantially flat within the neoprene material; and a third pair of weights integrated into thigh regions of the two leg compartments, each of the third pair of weights having:

a rubber pouch forming an interior cavity filled with a predetermined amount of iron sand and the rubber pouch wrapping from a front of the user's leg to a back of the user's leg, thereby placing a majority of the weight on a side of the user's thigh;

a second layer of neoprene integrally stitched to the sleeveless suit around a waist portion of the sleeveless suit;

wherein a combined weight of the first pair of weights and the second pair of weights is approximately equal to a total weight of the third pair of weights;

wherein each of the third pair of weights is positioned to wrap from a front of the user's leg to a back of the user's leg;

wherein each weight of the first, second, and third pair of weights is permanently integrated into the sleeveless suit to be completely enclosed by the neoprene material, the neoprene material completely surrounding each weight thereby being permanently incorporated into the sleeveless suit;

wherein the sleeveless suit has no weight on the user's arms;

wherein the first pair of weights are each 1.25 pounds;

wherein the second pair of weights are each 1.25 pounds;

wherein the third pair of weights are each 2.5 pounds;

wherein the sleeveless suit has a total weight of approximately 10 pounds; and wherein the sleeveless suit has no weight along the waist portion.

2. The weighted suit of claim 1, wherein the neoprene material is 100% latex free.

* * * * *